US005566867A

United States Patent [19]

Goray

[11] Patent Number: 5,566,867

[45] Date of Patent: Oct. 22, 1996

[54] CUSTOMIZABLE GARMENT FORM SYSTEM

[76] Inventor: Jill Goray, 3323 Clay St., San Francisco, Calif. 94118

[21] Appl. No.: 418,166

[22] Filed: Apr. 4, 1995

Related U.S. Application Data

[63] Continuation of Ser. No. 69,131, May 28, 1993, abandoned.

[51] Int. Cl.[6] ..... A41H 5/00

[52] U.S. Cl. ..... 223/66; 223/68

[58] Field of Search ..... 223/66, 67, 68, 223/71, 84

[56] References Cited

U.S. PATENT DOCUMENTS

| | | | |
|---|---|---|---|
| 2,128,024 | 8/1938 | Haft | 223/68 |
| 2,187,965 | 1/1940 | Browne | 223/68 |
| 2,263,720 | 11/1941 | De Carlo | 223/66 |
| 2,985,345 | 5/1961 | Hiscock | 223/68 |
| 3,305,146 | 2/1967 | Cram | 223/68 |
| 3,525,458 | 8/1970 | Mason et al. | 223/68 |
| 3,734,362 | 5/1973 | Arthur . | |
| 3,907,107 | 9/1975 | Vercollone . | |
| 4,839,206 | 6/1989 | Walderberger | 428/40 |

FOREIGN PATENT DOCUMENTS

| | | | |
|---|---|---|---|
| 474714 | 3/1929 | Germany | 223/66 |

OTHER PUBLICATIONS

Bruno Ferri, *New York Times*—Feb. 1993.

Suzanne Pierette Stern–Threads–Jan. 1993.

*Primary Examiner*—Bibhu Mohanty

*Attorney, Agent, or Firm*—Phillips, Moore, Lempio & Finley

[57] ABSTRACT

A kit of contoured foam pads (FIGS. 3 and 3*a*) is provided for attachment to an existing garment form (FIGS. 1 and 4) with double-sided adhesive tape (42), in order to duplicate the shape of a person to be fitted by a dressmaker or tailor. The pads are further secured by a fabric cover of stretch material (38 and 62) thus supporting the size and shape of the garment form (FIGS. 2 and 4) to accommodate many different individuals. The pliable foam pads are held to the form by the elastic cover (38 and 62) stretched over the form. The cover is then secured at the bottom with a drawstring (40). Each pad, labeled according to its appropriate position (56), enlarges any or all anatomical parts of the garment form (FIGS. 2, 4 and 5). For even further flexibility, smaller pieces of foam (36) can be attached to any of the individual foam pads to enlarge selected sections of the form. The flexibility in the sizing of an existing garment form greatly broadens the use of conventional garment forms.

1 Claim, 5 Drawing Sheets

MEASUREMENT CHART
Women

1. Back shoulders
2. Front shoulders (width across chest as high as possible)
3. Distance between bust points
4. Bust (half-measurement)
   Front
   Back
5. Waist (half-measurement)
   Front
   Back
6. Upper hip (3" down from waistline)
   Front
   Back
7. Thighs (widest point of shoulder to hipline)
8. Back hips (from side to side)
9. Body length (high point of shoulder to waist))
   Front
   Back
10. Lower body length (waist to widest point of hipline)
    Front
    Back

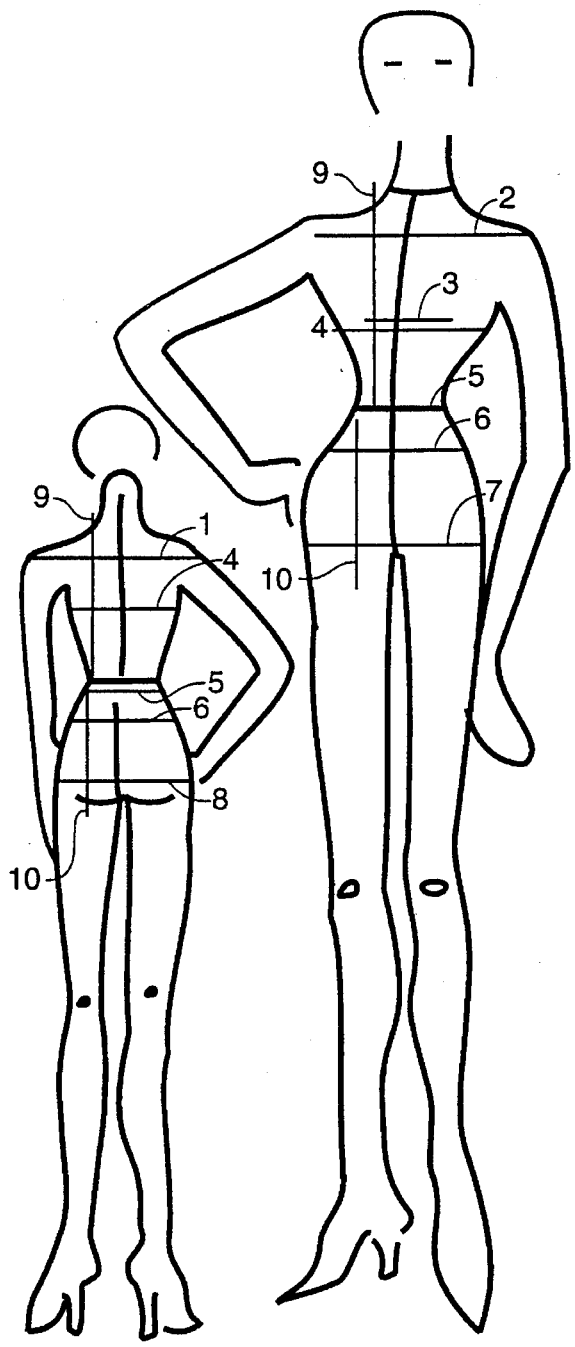

FIG._6

MEASUREMENT CHART
Men

1. Chest
2. Waist (half-measurement)
   Front
   Back
3. Back shoulder
4. Across shoulder (4" down)
5. Neck
6. Upper hip (3" down from waist) (half-measurement)
   Front
   Back
7. Body length (high point of shoulder to waist)
   Front
   Back

CUSTOMIZABLE GARMENT FORM SYSTEM

This is a continuation of application of Ser. No. 08/069,131 filed on May 28, 1993, now abandoned.

BACKGROUND—FIELD OF INVENTION

This invention relates to garment forms and retail display mannequins for women and men, specifically to a form method which can accommodate the design, fitting, and displaying of many body shapes.

BACKGROUND—DESCRIPTION OF PRIOR ART

Numerous garment forms exist on the market to help designers, dressmakers, and tailors make well-fitting dresses, blouses, skirts, jackets, and other garments. Invariably, these garment forms reproduce, as closely as possible, the body measurements of a particular individual, or group of individuals, for whom the clothes are being made. Some garment forms adjust so that as body measurements change, corresponding changes can be made in the garment form.

U.S. Pat. No. 3,734,362 to Arthur (1973), discloses a garment form consisting of a plurality of sections that are adjustable. The overall circumferential size of the portions can be increased or decreased by setting dials for each part of the form. However, adjustments by the dials are made to general body measurements. Singularities such as buttocks, thighs, curved backs or a stomach, are not accommodated on this form. Also, the separability of the sections makes the garment form unstable when enlarged. Lastly, the garment form has an outside layer which is made of a hard material which will not accept pins for attaching fabric to the form.

U.S. Pat. No. 3,525,458 to Mason and Stewart (1970) discloses a garment form made of a resilient foam material that allows pins to be inserted into the form. This garment form is a large pinnable, shapeless cylinder which is shaped by a corset-like cover at the waist, and at the bust by the user's brassiere. Separate pads also shape the brassiere. However, the cover is not interchangeable with other garment forms. Also, the cover does not accommodate body singularities, such as hips, thighs, curved backs, or large buttocks. Finally, garment forms of resilient foam bases are unstable for professional draping.

These and other professional garment forms do not allow tailors to make perfectly fitted garments because they are not made to exact body measurements. As stated in "One Size Fits All the Way to Middle Age" by Bruno Ferri, (*New York Times* February, 1993), president of Wolf Form Company, body changes are a function of aging, not of diet and exercise. "Shoulders, for example, rotate forward (as one ages) so blouses stretch across the shoulder blades and are loose across the chest". Sixty years ago, he said, a size 10 dress form had a 34.5 inch bust, a 24.5 inch waist and a 34.5 inch hipline. Today there is no standard size 10 and the smallest size 10 form Wolf makes has a 35.5 inch bust, a 26 inch waist and a 37 inch hipline. This article depicts a garment form custom made to standard overall body measurements. This form, however, does not accommodate individual singularities within most normal figures. Even the most professional and expensive garment forms, as presently exist, do not sufficiently accommodate unique body types, since body proportions vary substantially from one person to the next.

U.S. Pat. No. 3,907,107 to Vercollone (1975), discloses a garment form kit which can be assembled and customized by the consumer. It involves fitting pattern sections to an individual and then spraying the pieces with adhesive and adhering them together to form a solid fabric foam laminate. Although this form does allow for singularities, it can be successful on only one individual. Also, the hard shell will not accept pins.

Similarly, Suzanne Pierrette Stem, (*Threads* Magazine, January 1993), shows a way of individualizing a garment form. It involves padding an existing garment form with lambswool adhered to the form with fusible thin material. The form is then covered with a fabric shell customized to the individual's body measurements. This is a useful, yet time consuming, mode of approaching professional draping. This method can be successful for only one individual, as the cover cannot easily be removed and replaced.

When using current garment forms, the dressmaker or tailor must estimate where and how much to modify the professional or commercial pattern in order to accommodate differences in body singularities. This is difficult to do and leads to time consuming, repeat fittings and alterations. Most dressmakers and tailors end up fitting the garment to the form after it is partially assembled and estimating the changes that must be made to make the garment fit. Estimating changes is a difficult and time consuming process. Merely estimating the exact dimensions of an individual on the garment form consequently leads to great error in fitting. It requires the ability to analyze the particular problem and formulate steps needed to correct it. Not even the most professional pattern makers can eliminate errors in this process. Then, there is always the possibility that the user has already cut away the needed fabric to make the required corrections.

To summarize, all prior-art forms and methods of individualizing garment model forms suffer from the following disadvantages:

(a) Professional garment forms do not allow for singularities and abnormalities in body measurements.

(b) Presently available adjustable forms are not stable for draping when the sections are enlarged.

(c) Customized forms are not interchangeable to accommodate several different body types using the same form.

(d) Currently available adjustable forms only allow for enlargements in major sections of the body.

(e) Dressmakers and tailors must estimate measurements on existing forms to accommodate body singularities, thus requiting expensive and time consuming repeat fittings.

(f) Most non-professional garment forms do not allow pinning.

(g) Used or older models of garment forms usually do not fit the larger more contemporary figure due to body changes.

(h) New garment forms are costly.

These and other difficulties with conventional garment forms and other garment form enhancers lessen the capacity to facilitate the making of custom fitting garments.

OBJECTS AND ADVANTAGES

Accordingly, several objects and advantages of my invention are:

(a) to provide a system of individualizing existing professional or custom garment forms, by using a series of detachable, pre-formed, foam pads, (b) to provide a system of enlarging the dimensions of a garment form to allow for singularities of the body, without interfering with the stability of the form, (c) to provide a system that can accommodate most singularities and abnormalities of many individuals using the same basic garment form, (d) to provide a system that can expand the dimensions of certain areas on a garment form or reduce dimensions by detaching previously attached pads, (e) to provide a system that eliminates estimating measurements on patterns to accommodate body singularities, and thus time consuming repeat fittings, (f) to provide a system that allows pins to be inserted into the form and without interfering with the stability of the form, (g) to provide a system that will accommodate aging body singularities, as well as "perfect" figures, (h) to provide an inexpensive system of enlarging existing professional or custom garment forms, (i) to provide a system that can alter the dress form to accommodate different proportions of height between vertical body measurements, and (j) to provide a system that easily adapts to use with most models and sizes of existing garment forms.

Further objects and advantages are to provide a system that is easily removed, easily stored, and easily replaced on the form when needed, and to provide an improved method of adapting professional and commercial patterns to the appropriate measurements of the body. This system is simple to use, inexpensive to manufacture, and provides a method that accommodates every body type for more perfectly fitting clothes.

Still further objects and advantages will become apparent when considering the ensuing description and drawings.

DRAWING FIGURES

In the drawings, paired figures have the same numbers and letters (L and R) to indicate left and right.

Figure 3:
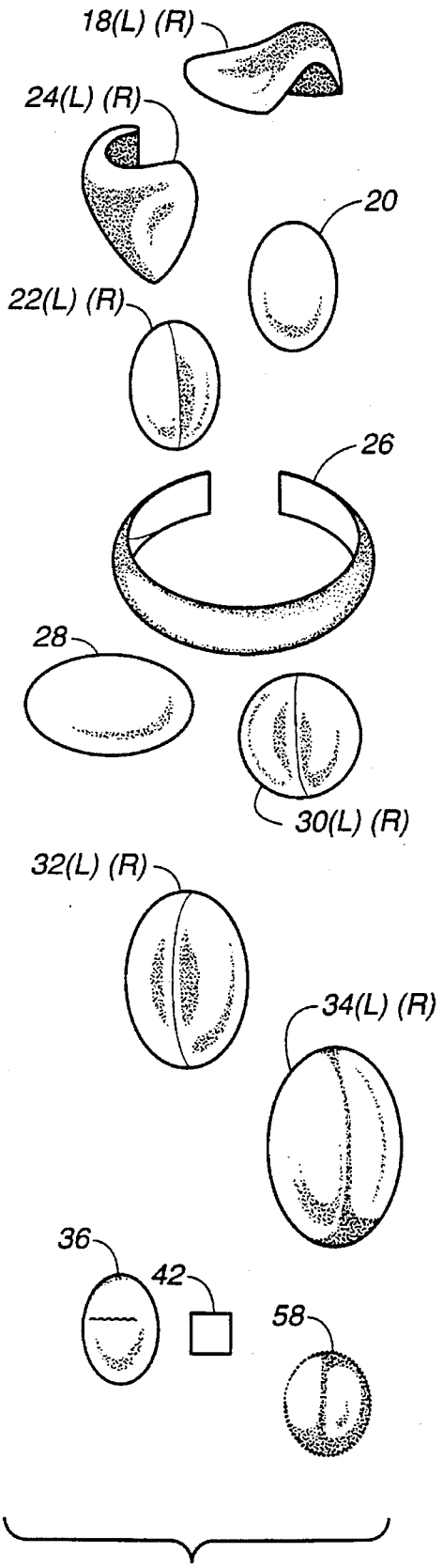
FIG. 3 shows a more detailed portrait of the foam with longitudinal seams where needed for women.
Figure 3A:
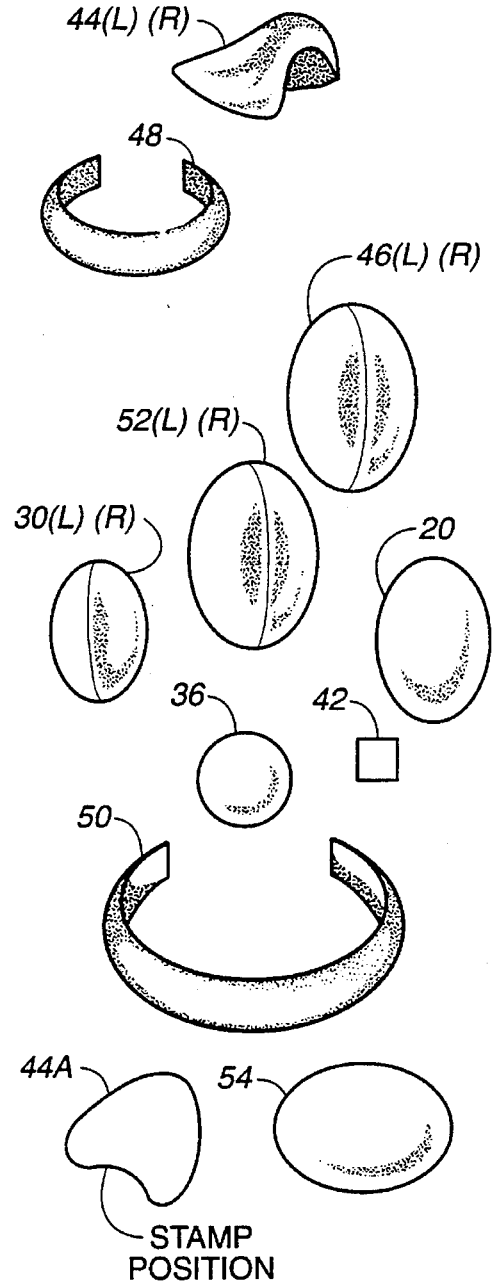
Figure 4:
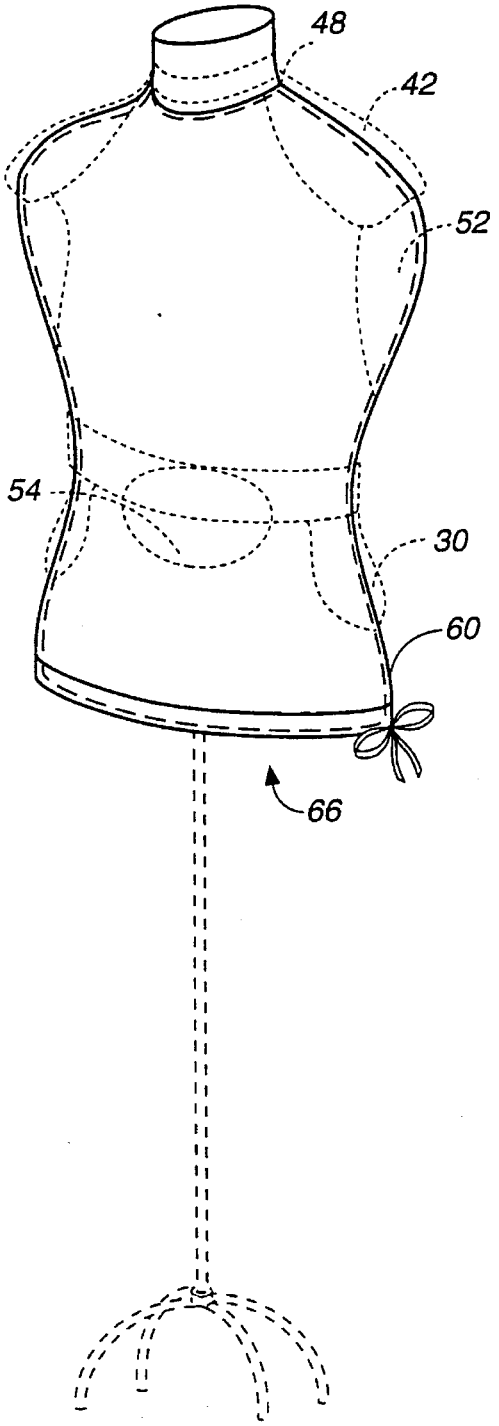
Figure 5:
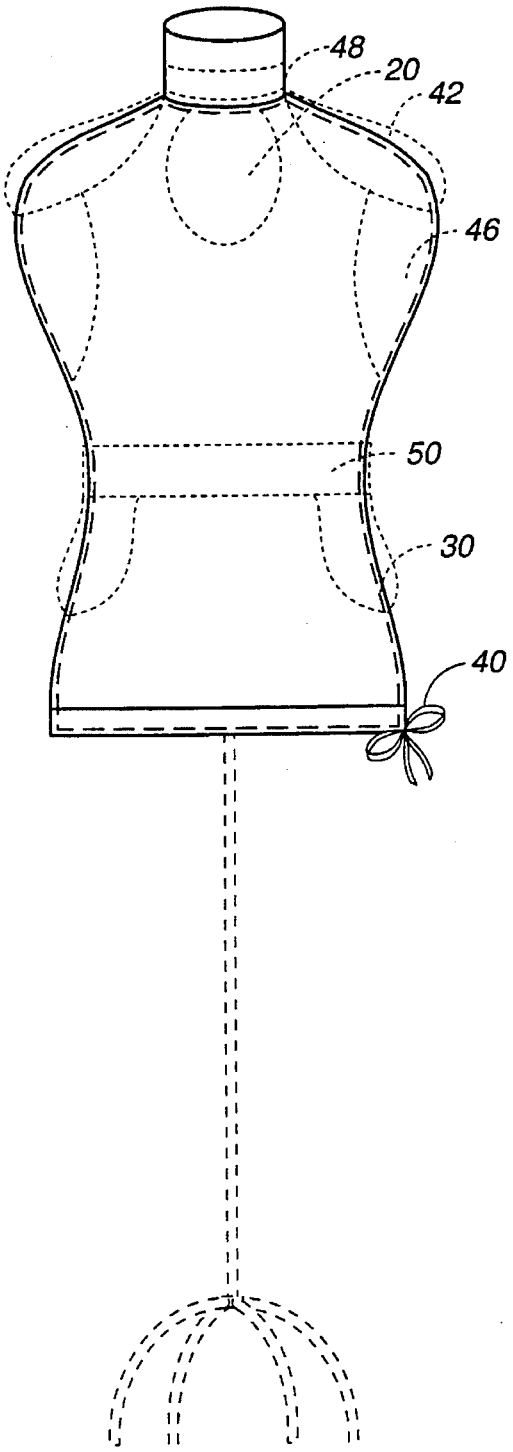
Figure 7:
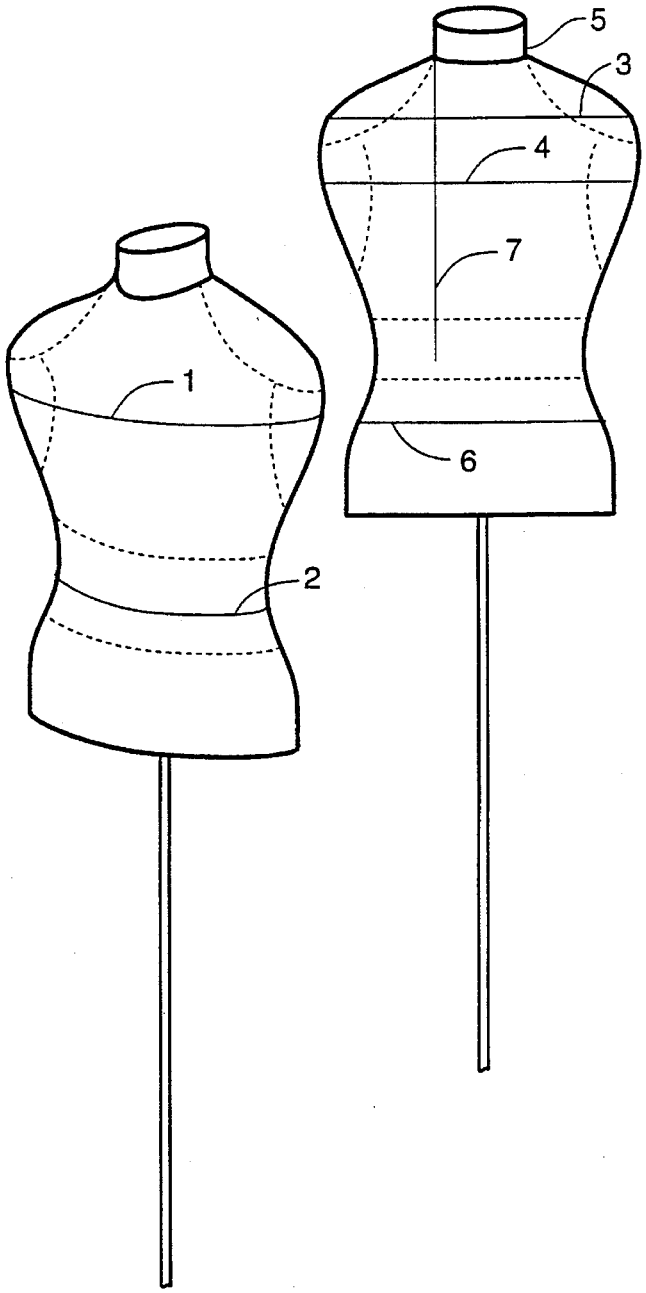

FIG. 3*a* shows a detailed description of the foam with longitudinal seams where needed on the men's garment form, FIG. 4 shows a front perspective view of the foam attached under a men's garment form stretch cover, FIG. 5 shows a back perspective view of the foam attached under the men's stretch cover, FIG. 6 shows a detailed measurement chart that allows for singularities and abnormalities on any individual woman's body type, FIG. 7 shows a detailed men's measurement chart that allows for singularities and abnormalities, in accordance with the invention.

REFERENCE NUMERALS IN DRAWINGS

18 (L)(R) contoured shoulder pads (for women)
20 upper back (for women and men)
22 (L)(R) side back (for women)
24 (L)(R) bust
26 waist (for women)
28 stomach (for women)
30 (L)(R) upper hip (for women)
32 (L)(R) lower thigh (for women)
34 (L)(R) back hip (for women)
36 additional foam inserts
38 stretch cover (for women)
40 drawstring
42 pressure sensitive double-sided adhesive
44 (L)(R) shoulder pads (for men)
44*a* foam pad position identification
46 (L)(R) upper side back (for men)
48 neck (for men)
50 waist (for men)
52 (L)(R) front chest (for men)
54 stomach (for men)
58 longitudinal seam on foam pad
60 seams on stretch cover (men and women)
62 men's stretch cover
64 existing garment form (for women)
66 existing garment form (for men)

SUMMARY

Figure 1:
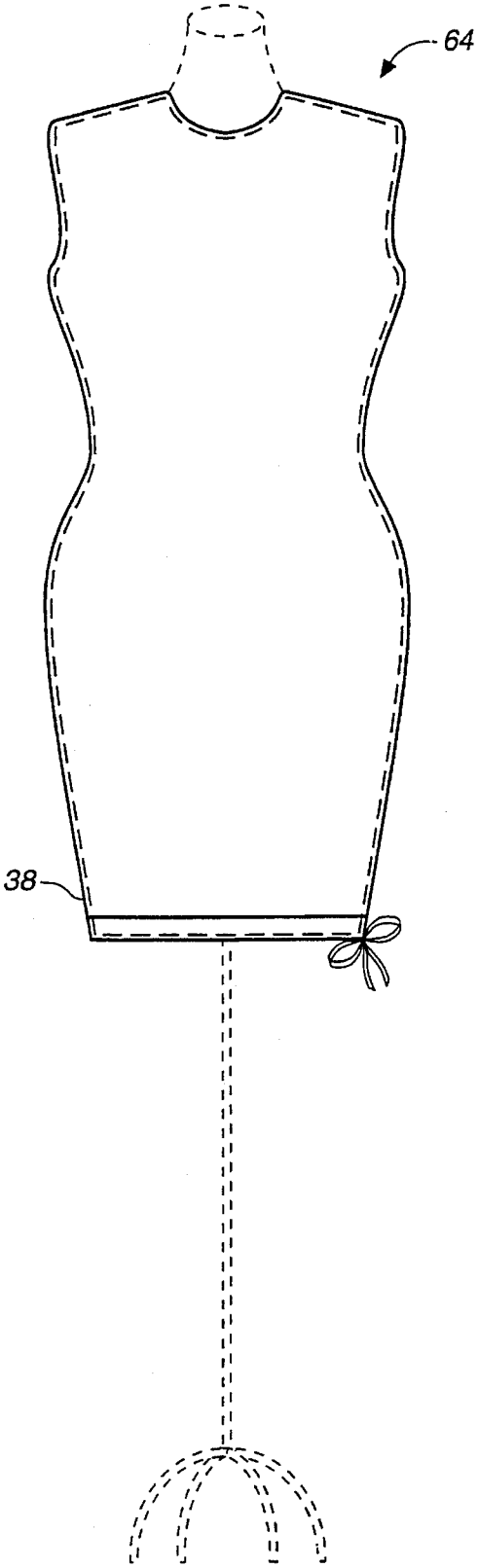
FIG. 1 shows a stretch cover in accordance with the invention as it appears on a form for women.
Figure 2:
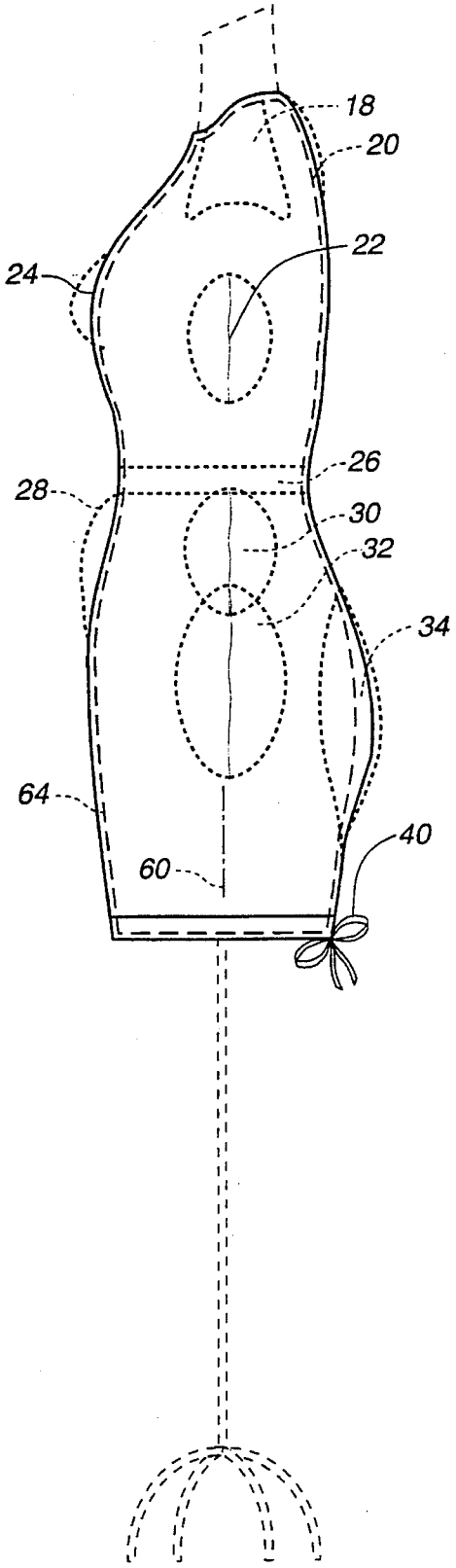
FIG. 2 shows a perspective view of foam pads on the form, as they appear under the stretch cover for women, in accordance with the invention.

In accordance with the invention a customizable garment form system is provided as a kit comprised of a group of contoured foam pads which have varying thicknesses (FIGS. 3 and 3*a*). The pads are made of pliable and smooth foam and are applied to a garment form (FIGS. 2, 4, and 5) with industrial adhesive backing. They are further secured by an elastic outer cover (FIGS. 1 and 4). The foam pads (with the elastic cover) hold pins firmly, so as to provide a stable, individualized garment form. The pads are contoured in varying thicknesses.

Description—FIGS. 3 and 3*a*—Pads

As shown in FIGS. 3 and 3*a*, form adjustment kit consists of a set of pads which are supplied in pairs (except where not needed) that can be attached to the appropriate area of a garment form (shown in broken lines at 64 and 66 in FIGS. 1, 2, 4 and 5). The pads for a woman's form, as shown in FIG. 3, include a pair of shoulder pads 18, an upper back pad 20,a pair of side back pads 22, a pair of bust pads 24, a waist pad 26, a stomach pad 28, a pair of upper hip pads 30, a pair of lower thigh pads 32, and a pair of back hip pads 34. The kit therefore includes 15 foam pads. These pads are ½" inch thick. The kit can also include a duplicate set of pads which are ¾" thick. Further, it includes 10 foam cushions 36 in ¼" thickness, and a stretch cover 38 with a drawstring 40 at the bottom.

The set of pads for a man's form include a pair of shoulder pads 44, a pair of upper back pads 20, a pair of side back pads 46, a waist pad 50, a pair of upper hip pads 30, a pair of from chest pads 52, a neck pad 48 and a stomach pad 54. The kit includes 13 foam pads in ½" thicknesses, 10 additional foam cushions 36 in ¼" thickness, and a stretch cover 62 with a drawstring 40 at the bottom. The men's kit can also include a duplicate set of pads which are ¾" thick. Each pad is shaped as indicated so as to fit on its corresponding part of form 64 and 66 to enlarge that part in the correct proportion.

In the preferred embodiment the pads are made of foam, although they can be made of any other pliable material that can be used repeatedly, such as rubber or cellular plastic. The pads should accept pins and duplicate individual body singularities on any standard garment form.

Each foam pad is stamped on the back to easily identify its appropriate position on the form. For example, as shown in FIG. 3*a*, shoulder pad 44*a* is indicated by "stamp position" on the underside of the pad, which in this case would be "shoulder".

An elastic cover 38 and 62 (FIGS. 1 and 4) is used to cover the form after the pads are attached. Seams 60 (FIGS. 1 and 4) on cover 38 and 62 also match longitudinal seams 58 on pads 22, 30, 34, 46 and 52 (FIGS. 3 and 3*a*). All of the seams should be vertical when the pads are attached to the form. This provides a smooth surface for pinning and draping when the seams on the cover are matched to the seams on the pads.

A 1" square 42 (FIG. 3) of pressure-sensitive, industrial adhesive with stickum on both sides is attached to the back of each foam pad. The adhesive attaches very securely to the foam pads, yet it can be easily removed and replaced many times due to different surface textures on most garment forms. Therefore, many different body types can use the original form for a more perfect fit.

In order to duplicate larger sizes, ten 3" round foam pieces 36 (FIGS. and 3*a*) are included in each kit. These small foam pieces can be attached to the back of any foam pad to enlarge the dimensions of the pad even further. The additional foam pieces are backed with industrial stickum on both sides for attachment to the pad and to the garment form.

Stretch Cover—FIGS. 1 and 4

After the pads are attached to the form (explained below) the stretch cover (FIGS. 1 and 4) is then placed over the garment form and tied at the base with a drawstring 40 to further secure the foam pads. As the stretch cover is pulled down over the form, it further shapes the soft, pliable foam pads by contouring them to the form. The pads can be applied to most existing garment forms. The system allows easy pinning, even when the existing garment form is made of a hard material that does not normally accept pins. The stretch cover is provided in men's and women's size ranges, in order to fit a variety of forms.

Each kit is accompanied by a measurement chart (FIGS. 6 and 6*a*) that considers most singularities in different body types. Each measurement is taken in half-measurements on the chart, to allow for singularities, such as a broad back or large bust. The measurement chart indicates where each pad should be attached so as to duplicate as closely as possible the measurements of the individual. For example, a woman with a 37" bust can be accommodated on a size 10 form with a 36" bust by attaching foam pads to the from or back according to her body singularities. If the front bust is larger than the back, the ½" pads 24 would be attached to the front of the form to duplicate the 37" measurement. A woman with a broad back would be duplicated on the form by adding ½" pads 22 to the back, and leaving off the front bust pads.

Operation

The first step in using the system is to obtain the exact measurements for whom clothing is to be made, according to the measurement chart (FIGS. 6 and 7). The separation of front and back measurements on the chart indicates where the pads are needed. The tailor or dressmaker measures each horizontal measurement separately, in order to account for the position of the pads. Taller or shorter women are accommodated by placing the pads higher or lower according to the vertical measurements on the chart. For example, suppose a dressmaker wants to duplicate a woman with a 20" front bust, a 17" back, a 28" waist, a 35" stomach, 38" buttocks, and 34" upper-hips on a standard size 10 dress form that measures a 19" front bust, a 16" back, a 26" waist, a 32" stomach and 36" buttocks. The dressmaker chooses from the kit (FIGS. 3 and 3*a*) the appropriate thickness and position of foam pads needed to enlarge the measurements of the existing form. The dressmaker would then add ½" pads 24 to the bust, 22 to the side back, 30 to the upper hip, 28 to the stomach and 34 to the back hip. Thus, the measurements of the individual are duplicated on the form.

Square 42 of double-sided adhesive on the back of each pad enables the pads to be applied by folding back the cover over the adhesive and applying the pad to the appropriate area, as stamped on back 44*a* of the pad. Additional foam cushions 36 with self-adhesive backing can be applied to the back of any foam pad to increase the thickness in ¼" increments. The same procedure is repeated to duplicate a man's measurements on a garment form. Once the closest approximation to the individual's measurements has been achieved, elastic cover 38 and 62 (FIGS. 1 and 4) is stretched over the padded form. The cover is first held over the form, stretched widely, and brought slowly down to cover the form so as not to displace the pads. Seams 60 on the stretch cover are matched to the seams on foam pads 44*a* until the form is completely covered and there is a tight fit. The fabric at the bottom of the cover is then gathered together and tied tightly with the supplied drawstring 40. The padded covered form, thereupon duplicates the individual's measurements and is stable and suitable for pinning, fitting and draping.

Thus, the pads enable a form to be enlarged to a wide range of individual measurements and also customizes individual singularities that do not appear in the overall measurements. Only with this type of system can a tailor perfectly reproduce (for example) a woman with a large stomach and small buttocks on a garment form. These types of dimensions, not apparent in the overall measurements, can be exactly reproduced on the form. The designer can add a pad to the stomach and leave off pads on the buttocks of the form. The measurement chart (FIGS. 6 and 7), detail the vertical and horizontal position of the pads for duplicating exact body singularities.

Accordingly, the form can be used to correct most professional and commercial patterns. Thus, modifications to the commercial pattern need not be merely estimated. The dressmaker or tailor simply pins the pattern pieces to the individualized form, and thus will show where the alterations are needed. The needed alterations are readily apparent and can be marked on the pattern. Accordingly, well-fitting clothes can be made from commercial patterns in most styles.

The technique disclosed here greatly simplifies the art of designing, dressmaking, and tailoring. The kit for individualizing an existing professional or commercial garment form is inexpensive, and the components, when used as directed, will allow most garment forms to match the needs of the individual in terms of singularities, ease, and comfort.

Summary, Ramifications and Scope

The reader will see that I have provided a kit to enhance a garment form that can duplicate, as closely as possible, the body measurements of an individual. The system can be used by persons from students to professionals in manufacturing, theatrical costuming, or home use. Its value can range from testing fashion designs for any size woman from buxom to stout. The system can enlarge and individualize most existing garment forms, new or used. It can accommodate several different body types using the same form. The system can duplicate exact body contour and dimensions accommodating abnormalities and singularities on any size or model form. The customizable garment form system is inexpensive to manufacture and easy to use.

While my above description contains many specificities, these should not be construed as limitations on the scope of the invention, but rather, as an exemplification of one preferred embodiment thereof. Many other variations are possible. For example, foam pads can be made from other pliable materials, such as rubber or cellular plastic. The pads can be molded without seams. The pads can be attached to the form by means of an inside liner, with hook and loop fasteners, inside pockets, or other means of attachment to the inside or outside cover. The cover can be made of another kind of fabric, or secured with a zipper rather than a stretch cover with a drawstring. The cover can be made of foam to enlarge a half-body form. Additions can be added to the cover as custom ordered. Foam pads can be offered in varying thicknesses and sizes without the use of additional foam backings.

Thus, the scope of the invention should be determined by the appended claims and their legal equivalents, rather than the examples given.

I claim:

1. A kit for modifying the shape of a body form to conform the body form to various human shapes; the kit comprising, a plurality of pairs of bust pads, each of said pairs of bust pads of a different shape, a plurality of pairs of hip pads, each of said pairs of hip pads of a different size, a plurality of pairs of buttock pads, each of said pairs of buttock pads of a different size, a plurality of stomach pads, each of said stomach pads of a different size, a plurality of pairs of shoulder pads, a measurement chart for recording selected measurements of an actual human body for further transposition to the body from, thereby locating selected positions on said body form for placement of the at least some of a pair of bust pads, a pair of buttock pads, a stomach pad and a pair of shoulder pads on said body form, elastic cover means for placement over said body form with at least some of said pads positioned on said body form at said selected positions.

* * * * *